United States Patent [19]

Ogata

[11] Patent Number: 4,835,567

[45] Date of Patent: May 30, 1989

[54] PAPER RE-FEEDING APPARATUS OF IMAGE FORMING APPARATUS

[75] Inventor: Fumio Ogata, Yokohama, Japan

[73] Assignee: Kabushiki Kaisha Toshiba, Kawasaki, Japan

[21] Appl. No.: 139,023

[22] Filed: Dec. 29, 1987

[30] Foreign Application Priority Data

Dec. 30, 1986 [JP] Japan ..... 61-311858

[51] Int. Cl.[4] ..... G03G 15/00

[52] U.S. Cl. ..... 355/318; 271/164; 355/319

[58] Field of Search ..... 355/3 SH, 14 SH, 50, 355/24, 26; 271/162, 164

[56] References Cited

U.S. PATENT DOCUMENTS

| | | | |
|---|---|---|---|
| 4,453,819 | 3/1984 | Wada et al. | 355/3 SH |
| 4,660,963 | 4/1987 | Stemmle | 355/3 SH |
| 4,671,644 | 6/1987 | Sumida et al. | 355/3 SH |
| 4,740,817 | 4/1988 | Suzuki et al. | 355/3 SH |
| 4,748,470 | 5/1988 | Ibuchi | 355/3 SH |

FOREIGN PATENT DOCUMENTS

| | | | |
|---|---|---|---|
| 0002915 | 7/1979 | European Pat. Off. . | |
| 3228572 | 2/1983 | Fed. Rep. of Germany . | |
| 54-6552 | 1/1979 | Japan | 271/164 |
| 59-207333 | 11/1984 | Japan | 271/162 |

*Primary Examiner*—R. L. Moses

*Attorney, Agent, or Firm*—Foley & Lardner, Schwartz, Jeffery, Schwaab, Mack, Blumenthal & Evans

[57] ABSTRACT

An image forming apparatus includes a copying apparatus and a paper re-feeding apparatus. The paper re-feeding apparatus includes a paper guide unit for feeding paper having an image formed by the copying apparatus to the copying apparatus again. The paper guide unit includes an upper guide opposing the upper surface of the paper, and a lower guide opposing the lower surface of the paper. The paper guide unit also has a main frame for supporting the upper guide, and a subframe for supporting the lower guide. The subframe can be pulled out from the main frame. When the subframe is pulled out, the upper and lower guides are separated vertically, thereby widening a convey path for the paper.

12 Claims, 15 Drawing Sheets

PAPER RE-FEEDING APPARATUS OF IMAGE FORMING APPARATUS

BACKGROUND OF THE INVENTION

The present invention relates to a paper re-feeding apparatus of an image forming apparatus, which re-feeds paper, on which an image has been formed by an image forming section, to the image forming section to form images on the both surfaces of the paper, or to form overlaid images on the paper.

A double-side copying machine for forming copy images on the both surfaces of paper is widely known as a recently developed image forming apparatus such as an electrographic copying machine.

Such a double-side copying machine includes a copying apparatus and a paper re-feeding apparatus. In the double-side copy mode, an image is formed on one surface of paper by an image forming section of the copying apparatus. Then, the paper is turned by the paper re-feeding apparatus and fed to the image forming section again. Another image is formed on the other surface of the paper by the image forming section.

The paper re-feeding apparatus is arranged below the copying apparatus. The paper re-feeding apparatus includes a convey mechanism for conveying and turning paper. The convey mechanism includes components of a convey path such as paper convey rollers, paper guides, and a switching gate.

The convey mechanism can be separated into an upper convey unit and a lower convey unit with respect to the convey path so that paper can be removed when the paper is jammed in the convey path. More specifically, the upper convey unit is fixed, whereas a rear side of the lower convey unit is pivotally fixed to a rear side of the upper convey unit. When a front side of the lower convey unit is pivoted downward at a predetermined angle, the convey path between the upper and lower convey units is exposed, thereby allowing removal of the paper jammed in the convey path.

In the convey mechanism described above, since the lower unit is pivoted to expose the convey path, the convey path cannot be sufficiently exposed. In order to eliminate this problem, the lower convey unit may be pivoted further downward. In this case, however, the height of the paper re-feeding apparatus is increased, resulting in an increase in height of the double-side copying machine as a whole.

SUMMARY OF THE INVENTION

It is an object of the present invention to provide a paper re-feeding apparatus of an image forming apparatus, wherein a paper convey path can be widely exposed outside without significantly increasing the height of the apparatus so that paper jammed in the convey path can be easily removed.

According to an aspect of the present invention, there is provided a paper re-feeding apparatus of an image forming apparatus, which feeds paper, on a surface of which an image has been formed by image forming means, to said image forming means again, comprising:

first convey means opposing one surface of the paper;

second convey means opposing the other surface of the paper; and support means for supporting said first and second covey means such that said second convey means is moved with respect to said first convey means in directions along and perpendicular to a surface of the paper.

DETAILED DESCRIPTION OF THE PREFERRED EMBODIMENT

An embodiment of the present invention will now be described with reference to the accompanying drawings.

Figure 1:
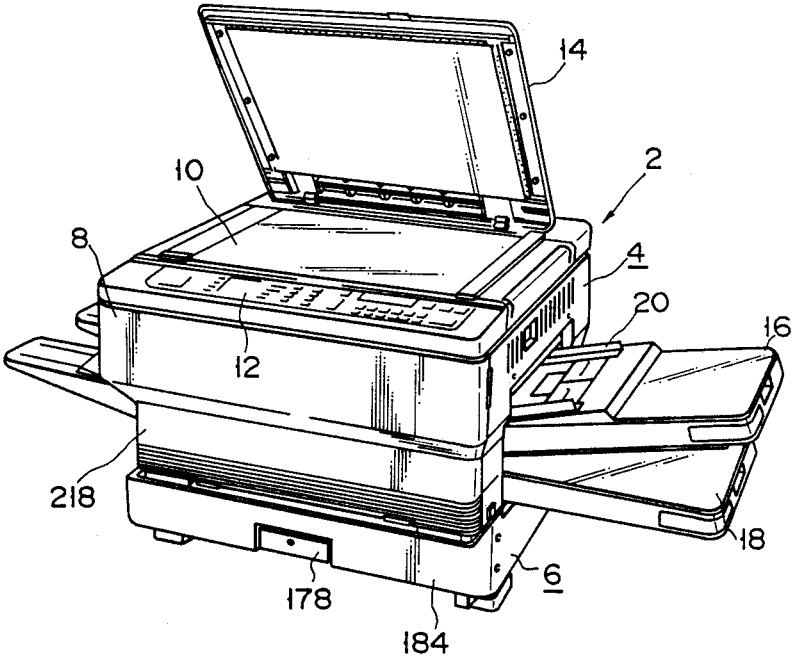
FIG. 1, is a perspective view of an image forming apparatus according to an embodiment of the present invention.
Figure 2:
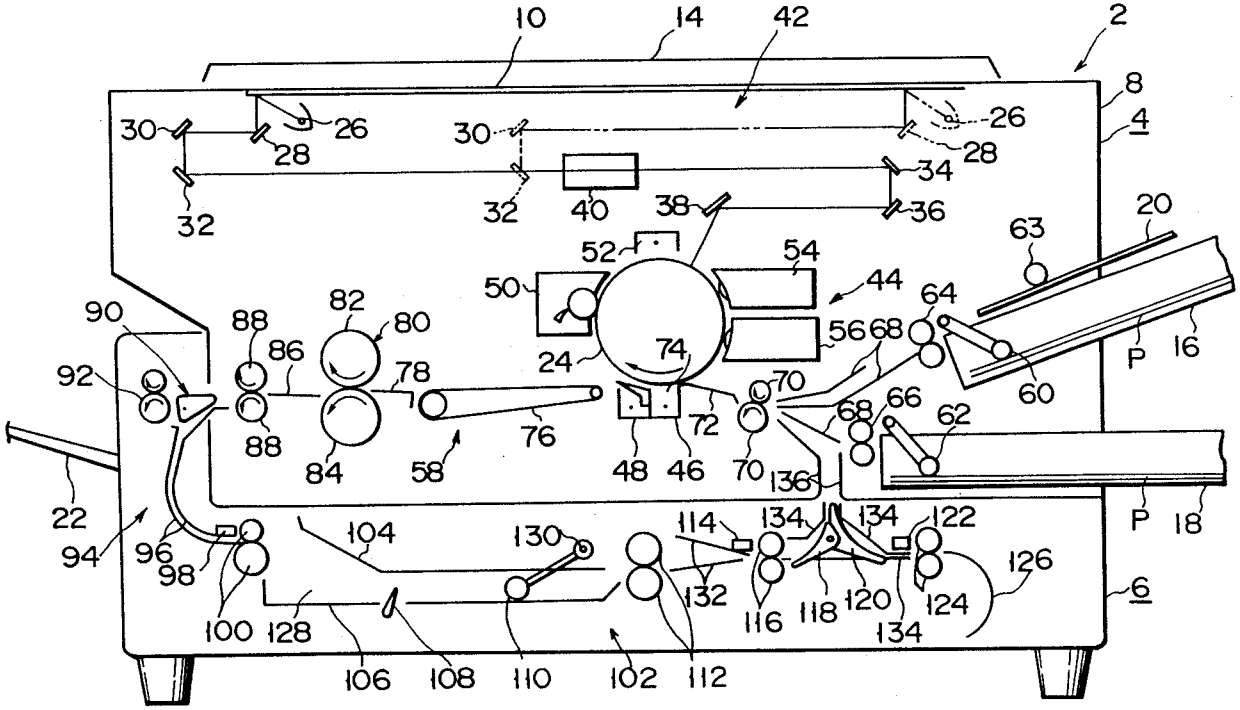
FIG. 2 is a schematic sectional view of the image forming apparatus in FIG. 1.

Referring to FIG. 1, reference numeral 2 denotes an electrographic copying machine capable of performing double-side and overlay copying operations as an image forming apparatus according to the present invention. Electrographic copying machine 2 comprises copying apparatus 4 and paper re-feeding apparatus 6.

Copying apparatus 4 includes housing 8. Original table 10 made of transparent glass is arranged on the upper surface of housing 8. Operation panel 12 is arranged on an upper front side of housing 8. Original cover 14 is pivotally supported on a rear side of housing 8. Upper and lower cassettes 16 and 18 storing paper are arranged on one side of housing 8. In addition, manual insertion guide 20 for manually feeding paper is arranged above upper cassette 16. Receiving tray 22 is arranged on the other side of housing 8.

Photosensitive drum 24 is arranged at substantially the center of housing 8 to be rotated in a direction indicated by the arrow. Scanning unit 42 having lamp 26, a plurality of mirrors 28, 30, 32, 34, 36, and 38, and lens 40 is arranged between photosensitive drum 24 and original table 10. An original on original table 10 is illuminated by lamp 26. Reflected light from the original is guided and focused onto photosensitive drum 24 through mirrors 28, 30, 32, 34, 36, and 38, and lens 40. At this time, lamp 26 and mirror 28 are moved at a speed twice that of mirrors 30 and 32. As a result, the length of the optical path from the original to photosensitive drum 24 is kept constant.

Developing apparatus 44, transfer charger 46, separating charger 48, cleaner 50, and charger 52 are arranged in the order named around photosensitive drum 24 from an imaging position by scanning unit 42 along its rotational direction. The surface of photosensitive drum 24 is evenly charged by charger 52. Toner is applied onto photosensitive drum 24 by developing apparatus 44 to develop an electrostatic latent image. As a result, a toner image is formed. Developing apparatus 44 comprises first and second developing units 54 and 56. Developing units 54 and 56 use toner having different colors. The toner image on photosensitive drum 24 is transferred onto paper P by transfer charger 46. Paper P is separated from photosensitive drum 24 by separating charger 48. Cleaner 50 removes the residual toner, which is not transferred from photosensitive drum 24 onto paper P and left on photosensitive drum 24.

Convey mechanism 58 is arranged in a bottom portion of housing 8 so as to convey paper P from upper or lower cassette 16 or 18, or manual insertion guide 20 toward receiving tray 22. More specifically, paper P stored in upper or lower cassettes 16 or 18 is picked out by pickup rollers 60 or 62 one by one. Paper P thus picked out is conveyed toward a pair of aligning rollers 70 through a pair of convey rollers 64 or 66, and guides 68. Paper P inserted in manual insertion guide 20 is fed to convey roller 64 by pickup roller 63 and is conveyed to aligning rollers 70. Paper P is aligned by aligning rollers 70. Then, paper P is conveyed to transfer position 74 through guide 72. Paper P is brought into contact with photosensitive drum 24 at transfer position 74. In this state, a toner image on photosensitive drum 24 is transferred onto paper P. Paper P is separated from photosensitive drum 24 by separating charger 48. Then, paper P is conveyed to fixing unit 80 through convey belt 76 and guide 78. Fixing unit 80 includes heat and press rollers 82 and 84. A release agent layer such as fluorine resin is formed on the surface of heat roller 82. Press roller 84 is biased toward heat roller 82. Paper P is conveyed by heat and press rollers 82 and 84 while being heated and pressed. As a result, the toner image on paper P is fixed thereon. Thereafter, paper P is sent to a pair of paper-discharge rollers 88, and guided outside housing 8 by discharge rollers 88. When copying apparatus 4 is to be independently used, receiving tray 22 is attached to housing 8. Paper P is discharged onto receiving tray 22 by paper-discharge rollers 88.

When paper re-feeding apparatus 6 is coupled to copying apparatus 4, receiving tray 22 is attached to paper re-feeding apparatus 6. Paper P having a toner image fixed by fixing unit 80 is sent to paper re-feeding apparatus 6 by paper-discharge rollers 88.

Paper re-feeding apparatus 6 includes first gate 90. First gate 90 selectively guides paper P sent from paper-discharge rollers 88 to paper-discharge rollers 92 or paper turn unit 94. Paper-discharge rollers 92 discharge paper P onto receiving tray 22. Paper turn unit 94 includes a pair of guides 96, jammed paper detecting switch 98, and a pair of stack rollers 100. Guides 96 guide paper P guided by first gate 90. Jammed paper detecting switch 98 detects whether paper P is jammed between guides 96. Stack rollers 100 convey paper P guided by guides 96 toward paper guide unit 102.

Paper guide unit 102 comprises upper and lower stack guides 104 and 106, stack switch 108, pickup roller 110, a pair of separation rollers 112, aligning sensor 114, a pair of aligning rollers 116, second gate 118, third gate 118, switchback sensor rollers 124, and switchback guide 126. Stacker 128 for stacking paper P sent by stack rollers 100 is formed between upper and lower stack guides 104 and 106. Stack switch 108 detects whether paper P is stored in stacker 128. Pickup roller 110 is pivotally supported by support shaft 130 so as to pick up paper P stored in stacker 128. Separation rollers 112 separate each sheet of paper P picked up by pickup roller 110. Aligning sensor 114 detects paper P separated by separation rollers 112. Aligning rollers 116 align paper P in accordance with the detection result by aligning sensor 114. Second gate 118 selectively guides paper P aligned by aligning rollers 116 toward switchback rollers 124 or aligning rollers 70 in copying apparatus 4. Third gate 120 guides paper P switched back by switchback rollers 124 toward aligning rollers 70 in copying apparatus 4. Switchback rollers 124 switch back paper P to turn paper P. Switchback sensor 122 detects leading and trailing edges of paper P switched back by switchback rollers 124. Paper guide unit 102 further comprises a pair of guides 132 for guiding paper P toward aligning rollers 116, and three guides 134 arranged around second and third gates 118 and 120. Copying apparatus 4 is provided with a pair of guides 136 for guiding paper P sent from paper re-feeding apparatus 6.

Reconvey means are provided for conveying the paper sheet P from a position between image forming means or drum 24 and paper discharge means or rollers 92, to a position between paper feeding means or cassettes 16, 18, and drum 24. The reconvey means comprises a first convey means and a second convey means. The first convey means comprises first guide means and a first convey member including the upper one of the separation rollers 112. The first guide means comprises upper stack guide 104 and upper guide plate 132 opposing one surface of paper sheets P. The second convey means comprises second guide means and a second convey member including the lower one of the separation rollers 112. The second guide means comprises lower stack guide 106 and lower guide plate 132 opposing the other surface of paper sheets P.

Figure 3:
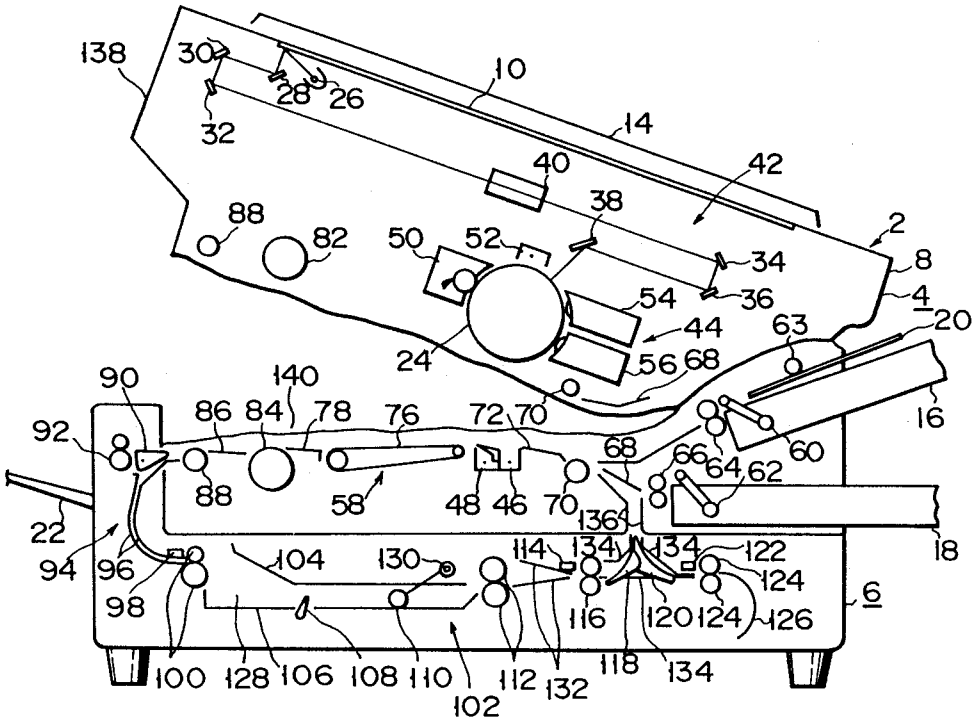
FIG. 3 is a schematic sectional view showing a state wherein an upper unit of a copying machine in the image forming apparatus in FIG. 1 is lifted up.

As shown in FIG. 3, copying apparatus 4 can be separated into upper and lower units 138 and 140 with respect to the convey path for conveying paper P from upper cassette 16 toward paper-discharge rollers 88 through transfer position 74. More specifically, upper unit 138 is pivotally supported on lower unit 140 through a support shaft (not shown) arranged near upper cassette 16. Scanning unit 42, photosensitive drum 24, charger 52, developing apparatus 44, cleaner 50, upper guide 68, upper aligning roller 70, heat roller 82, and upper paper-discharge roller 88 are arranged in upper unit 138. Pickup rollers 60, 62, and 63, convey rollers 64 and 66, lower guides 68, 72, 78, and 86, lower aligning roller 70, transfer charger 46, separating charger 48, convey belt 76, press roller 84, and lower paper-discharge roller 88 are arranged in lower unit 40.

Figure 4:
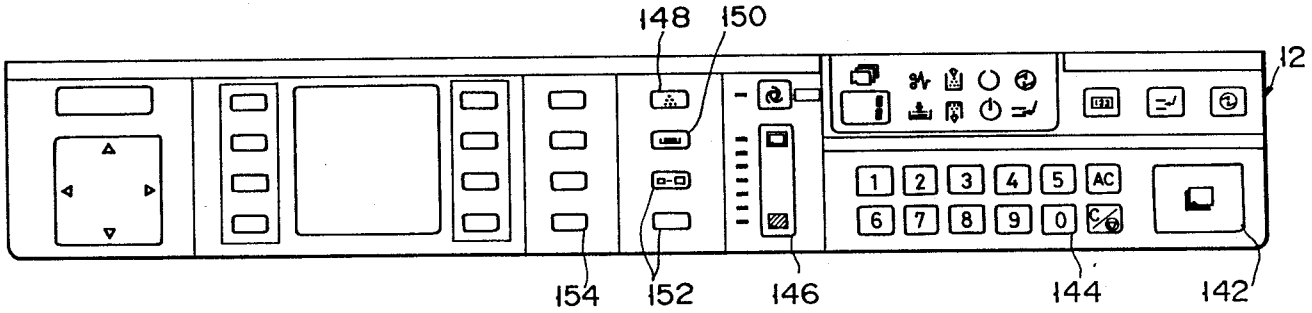
FIG. 4 is a plan view of an operation panel of the copying machine in the image forming apparatus in FIG. 1.

FIG. 4 shows operation panel 12. Referring to FIG. 4, reference numeral 142 denotes a copy key for starting the copying operation; 144, a ten key pad for setting a desired number of copies; 146, a density selection key for changing copy densities; 148, a color selection key for selecting first or second developing unit 54 or 56; 150, a cassette selection key for switching cassettes 16 and 18; 152, reproduction ratio keys for changing magnification; and 154, a double-side/overlay copy key for performing double-side/overlay copying operations.

Figure 5:
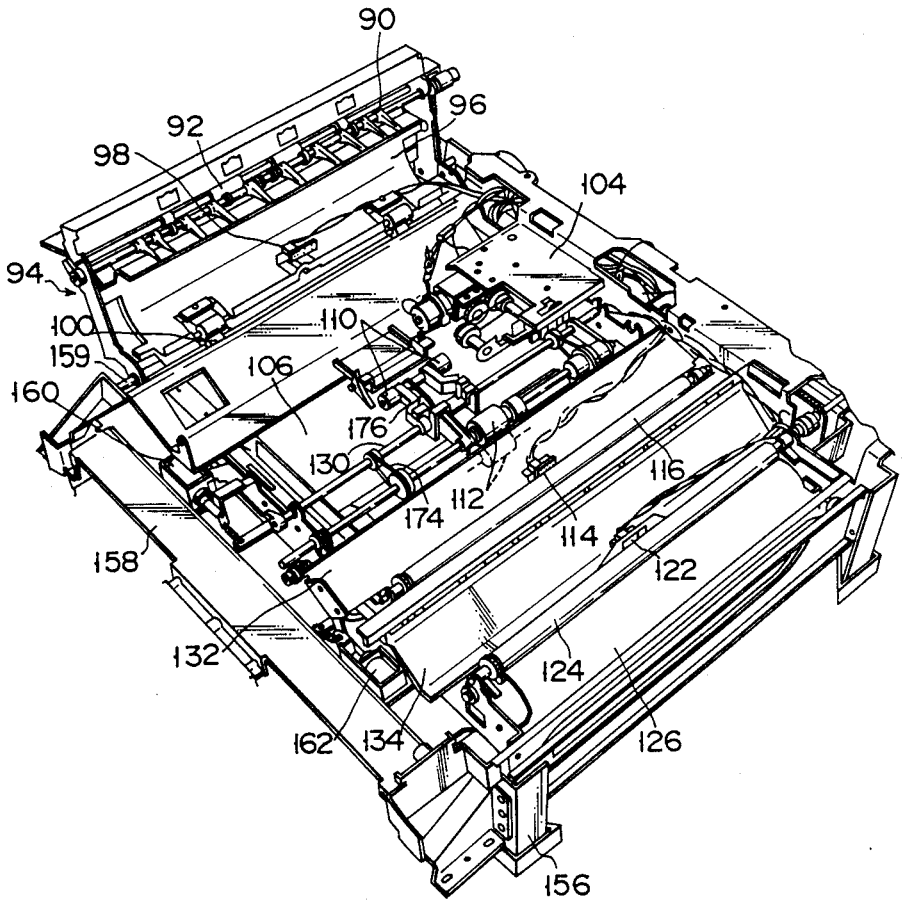
FIG. 5 is a perspective view of a paper turn unit and a paper guide unit of a paper re-feeding apparatus in the image forming apparatus in FIG. 1.

As shown in FIG. 5, paper guide unit 102 includes main frame 156 and subframe 158. In addition, paper turn unit 94 is pivotally supported on main frame 156 through shaft 160. Upper stack guide 104, aligning sensor 114, switchback sensor 122, and upper guide 132 are supported on main frame 156. Lower stack guide 106, stack switch 108, pickup roller 110, a pair of separation rollers 112, a pair of aligning rollers 116, second gate 118, third gate 120, switchback rollers 124, switchback guide 126, and lower guides 132 and 134 are supported on subframe 158. Subframe 158 is supported by main frame 156 to be pulled out. Solenoids 160 and 162 are supported on the front side of subframe 158. Solenoid 160 causes pickup roller 110 to be brought into contact with uppermost paper P in stacker 128. Solenoid 162 serves to actuate second gate 118.

Figure 6:
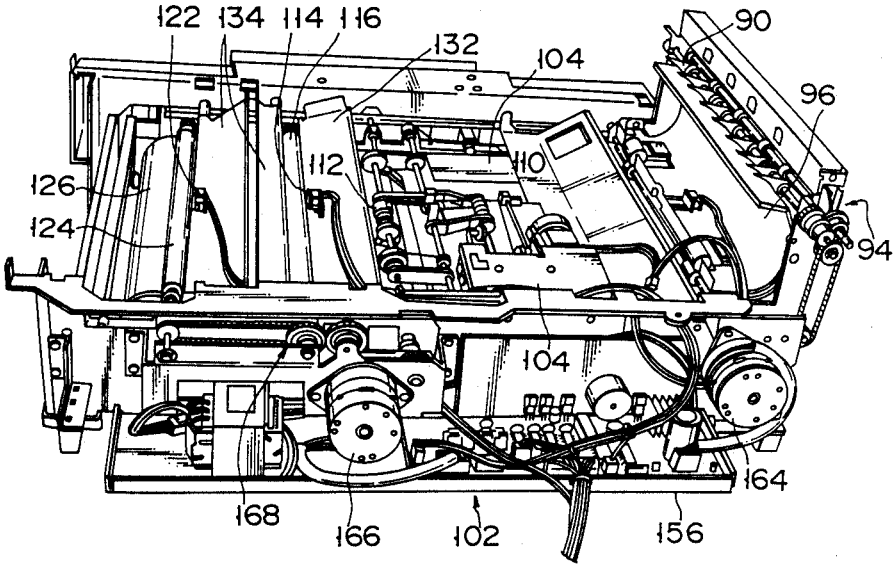
FIG. 6 is a perspective view of the paper turn unit and the paper guide unit in FIG. 5 when viewed from the rear side.

As shown in FIG. 6, first and second motors 164 and 166 are supported on the rear side of main frame 156. First motor 164 drives stack rollers 100. Second motor 166 drives pickup roller 110, separation rollers 112, aligning rollers 116, and switchback rollers 124 through driving force transmitting mechanism 168.

Figure 7:
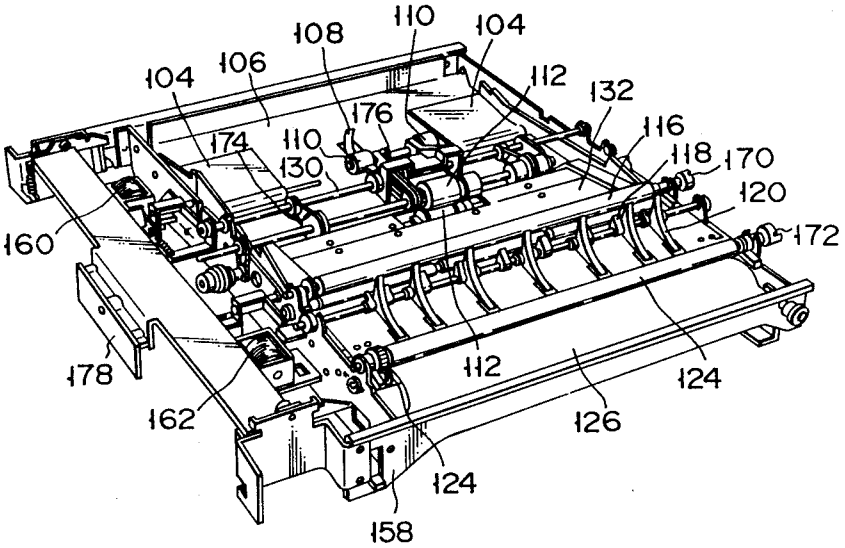
FIG. 7 is a perspective view of a subframe of the paper guide unit in FIG. 5.

As shown in FIG. 7, engaging portions 170 and 172 are formed on the rear sides of shafts which respectively support aligning and switchback rollers 116 and 124. When subframe 158 is attached to main frame 156, engaging portions 170 and 172 are engaged with driving force transmitting mechanism 168. With this arrangement, a driving force from second motor 166 is transmitted to aligning rollers 116 and switchback rollers 124 through driving force transmitting mechanism 168. When subframe 158 is pulled out from main frame 156, engaging portions 170 and 172 are released from driving force transmitting mechanism 168. The driving force from second motor 166 is also transmitted to support shaft 130, which pivotally supporting pickup roller 110, through driving force transmitting mechanism 168 and an engaging portion (not shown). The driving force of shaft 130 is transmitted to separation rollers 112 through belt 174, and transmitted to pickup roller 110 through belt 176. Handle 178 is arranged on the front side of subframe 158.

Figure 8:
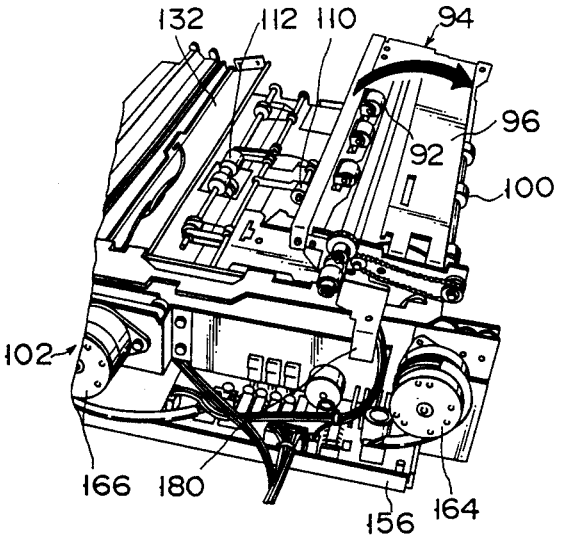
FIG. 8 is a perspective view showing a state wherein the paper turn unit is laid horizontally.

As shown in FIG. 8, when paper re-feeding apparatus 6 is packed, paper turn unit 94 is laid over paper guide unit 102, and fixed thereto by bracket 180. When paper re-feeding apparatus 6 is installed, paper turn unit 94 is pivoted in the direction indicated by an arrow and set substantially in an upright position. When copying apparatus 4 is set on paper re-feeding apparatus 6, paper turn unit 94 is further pivoted to be tilted. Upon setting, paper turn unit 94 is returned to the upright position.

Figure 9:
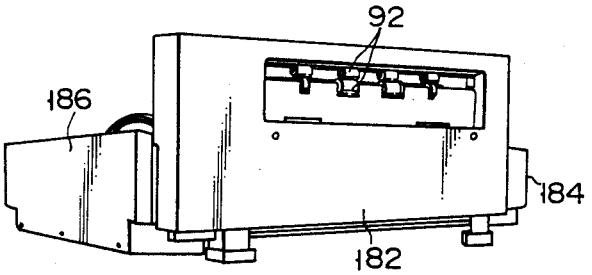
FIG. 9 is a perspective view of the paper re-feeding apparatus in the image forming apparatus in FIG. 1.

As shown in FIG. 9, side cover 182, front cover 184, and rear cover 186 are respectively fixed to turn unit 94, the front side of subframe 158 of paper guide unit 102, and the rear side of main frame 156.

Figure 10:
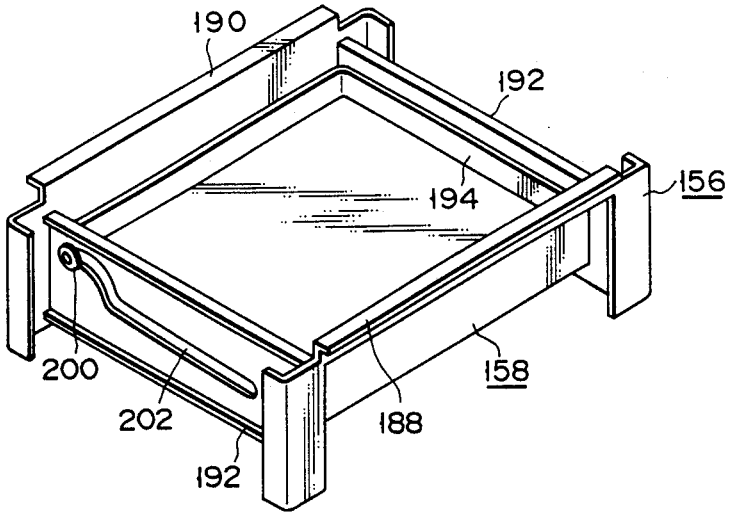
FIG. 10 is a perspective view of a main frame and the subframe of the paper guide unit in FIG. 5.

As shown in FIG. 10, main frame 156 includes front frame 188, rear frame 190, and a pair of side frames 192. Subframe 158 includes box-like frame 194. Box-like frame 194 is set between front, rear, and side frames 188, 190, and 192 of main frame 156.

Figure 11:
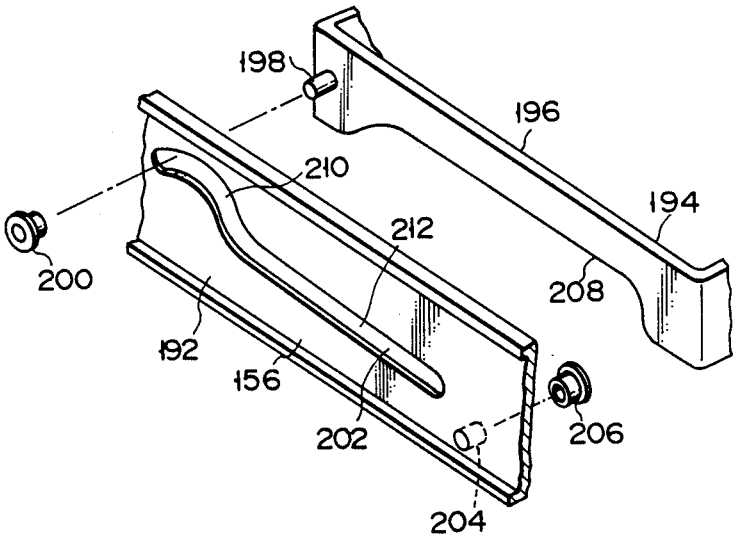
FIG. 11 is a perspective view showing an engaging means of the main frame and subframe of the paper guide unit in FIG. 10.

As shown in FIG. 11, support shaft 198 extends outward from the rear side of side wall 196 of box-like frame 194. Roller 200 made of, e.g., plastics is fixed to the distal end of support shaft 198. Guide groove 202 for guiding roller 200 is formed in side frame 192 of main frame 156. Support shaft 204 extends inward from the front side of side frame 192. Roller 206 is supported by support shaft 204. Guide surface 208 for guiding roller 206 is formed on the lower surface of side wall 196 of box-like frame 194 of subframe 158.

Figure 12:
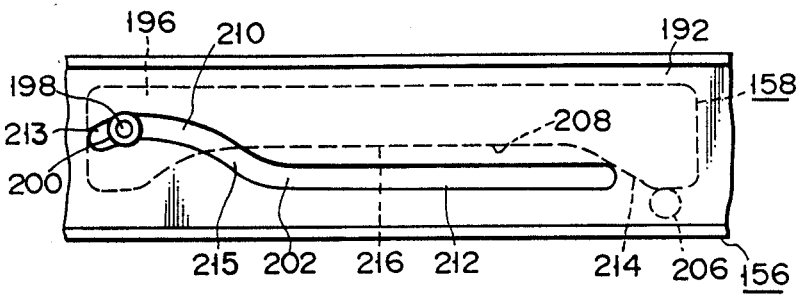
FIG. 12 is a side view of the engaging means in FIG. 11.

As shown in FIG. 12, guide groove 202 is constituted by curved portion 210 on the rear side and flat portion 212 on the front side. Curved portion 210 is constituted by ascending portion 213 ascending toward the front side, and descending portion 215 descending toward the front side. Ascending portion 213 extends to a position lower than descending portion 216. Flat portion 212 communicates with the lowermost end of descending portion 215. Guide surface 208 of box-like frame 194 is symmetrical with guide groove 202. More specifically, guide surface 208 is constituted by curved surface 214 on the front side and flat surface 216 on the rear side. With this arrangement, subframe 158 can be pulled out, while it is kept horizontal with respect to main frame 156. In addition, when subframe 158 is pulled out from main frame 156, the convey path in paper guide unit 102 is widened.

The normal copying operation will be described below. A toner image formed on photosensitive drum 24 is transferred onto one surface of paper P fed from upper or lower cassette 16 or 18, or manual insertion guide 20, and then fixed thereon by fixing unit 80. Paper P having a fixed image is sent from copying apparatus 4 to paper re-feeding apparatus 6 by paper-discharge rollers 88. Paper P is conveyed to paper-discharge rollers 92 by first gate 90, and then, discharged onto receiving tray 22 by paper-discharge rollers 92.

Figure 13:
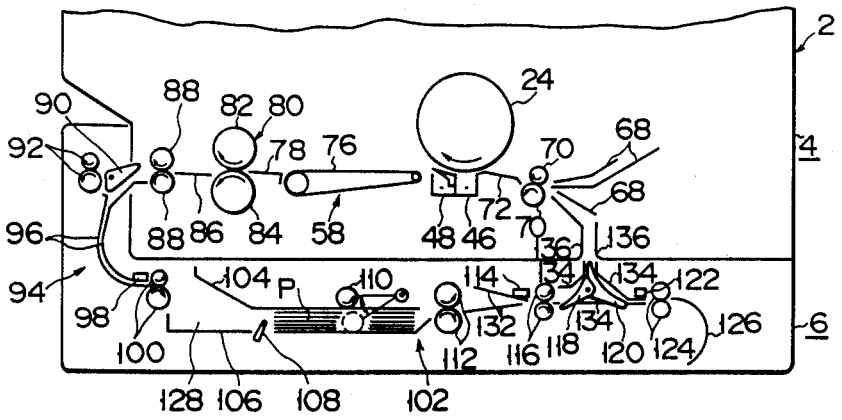
FIGS. 13 to 15 are views for explaining copying operations.
Figure 14:
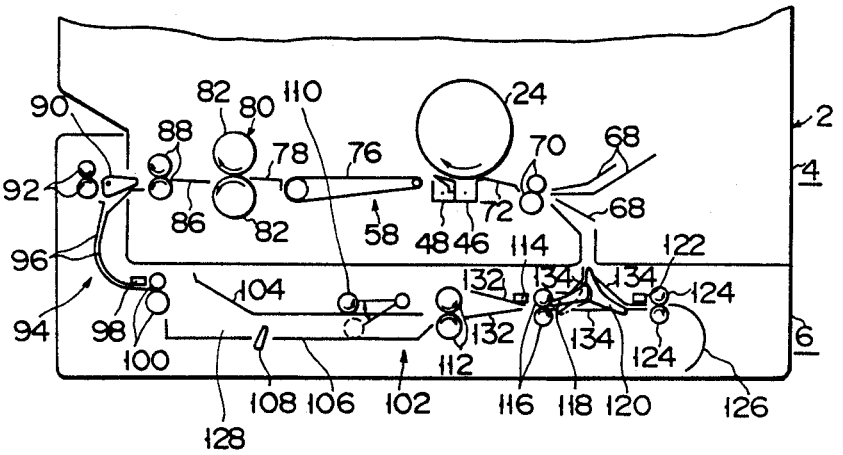
Figure 15:
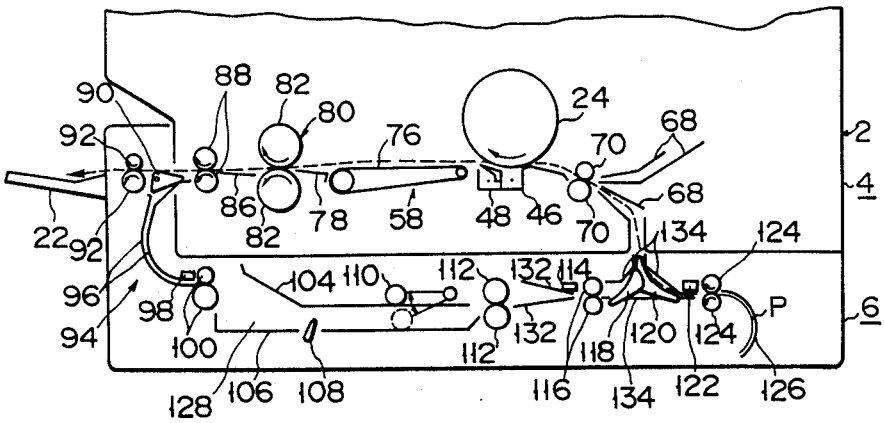

The double-side copying operation will be described below. When the double-side copying mode is selected by double-side/overlay copy key 154 on operation panel 12, and copy start key 142 is depressed, first motor 164 is rotated, and at the same time first gate 90 is actuated, as shown in FIG. 13. Paper P having an image formed by copying apparatus 4 on its one surface is guided to turn unit 94 by first gate 90. Thereafter, paper P is conveyed by stack rollers 100, and stacked onto stacker 128 while the image surface of paper P faces down. A desired number of sheets of paper is continuously stacked onto stacker 128. As shown in FIG. 14, when the next original is set and copy start key 142 is depressed after the stacking operation is finished, pickup roller 110 is lowered. When pickup roller 110 picks up the uppermost sheet of paper P from stacker 128, it is raised. If two sheets of paper P or more are picked up, lower separation roller 112 is rotated in the reverse direction so as to send the lower sheet of paper P back to stacker 128, thereby conveying only the uppermost sheet of paper P. When the leading edge of paper P reaches aligning rollers 116, paper P is aligned because aligning rollers 116 is stopped. Upon alignment of paper P, second gate 118 is actuated, and aligning rollers 116 are rotated. At the same time, switchback rollers 124 are rotated. As a result, paper P is sent to switchback guide 126. As shown in FIG. 15, when the trailing edge of paper P is detected by switchback sensor 122, aligning rollers 116 and switchback rollers 124 are simultaneously stopped, and second gate 118 is returned to the original position. Thereafter, switchback rollers 124 are rotated in the reverse direction and paper P is switched back. As a result, paper P is turned and guided to aligning rollers 70 in copying apparatus 4. A toner image on photosensitive drum 24 is transferred onto the reverse surface of paper P with respect to the image surface. After the toner image is fixed on paper P, paper P is discharged onto receiving tray 22 through paper-discharge rollers 88, first gate 90, and paper-discharge rollers 92. The above operation is repeated until all sheets of paper P stacked in stacker 128 have both surfaces copied and discharged. Third gate 120 is pivotally arranged and kept at a position shown in FIG. 5 by its own weight. Therefore, when paper P is sent to switchback guide 126, third gate 120 is rotated counterclockwise. When paper P is sent out from switchback guide 126, third gate 120 is not pivoted so as to guide paper P toward copying apparatus 4.

Figure 16:
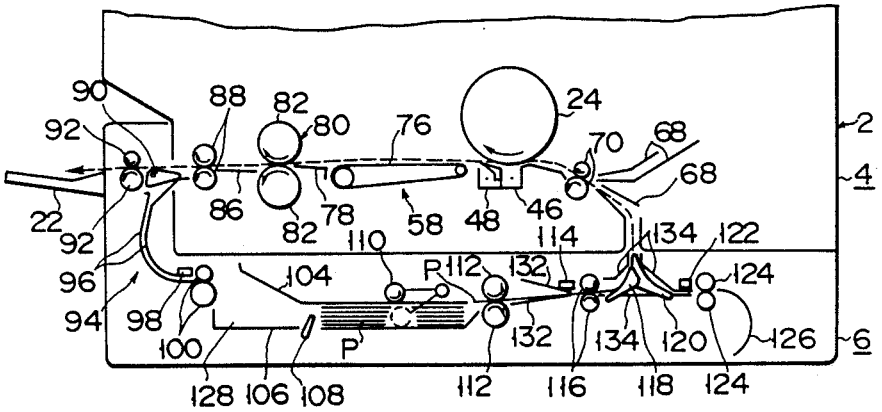

The overlay copying operation will be described below. When the overlay copying mode is selected by double-side/overlay copy key 154 on operation panel 12, and copy start key 14 is successively depressed, paper P is stacked in stacker 128 in the same manner as in the double-side copying mode. As shown in FIG. 16, when the next original is set and copy start key 142 is depressed after the stacking operation is finished, pickup roller 110 is lowered onto paper P stacked in stacker 128, and the uppermost sheet of paper P is sent out. If two sheets of paper P or more are sent out, lower separation roller 112 is rotated in the reverse direction. Thus, the lower sheet of paper P is sent back to stacker 128, thereby conveying only the uppermost sheet of paper P. Thereafter, pickup roller 110 is raised. When the leading edge of paper P reaches aligning rollers 116, paper P is aligned because aligning rollers 116 are stopped. Upon alignment of paper P, aligning rollers 116 are rotated and paper P is guided toward aligning rollers 70 in copying apparatus 4 by second gate 118. Subsequently, a toner image on photosensitive drum 24 is transferred onto the same surface of paper P, on which the image is previously formed. After the toner image is fixed on paper P, paper P is discharged onto receiving tray 22 through paper-discharge rollers 88, first gate 90, and paper-discharge rollers 92. The above operation is repeated until all the sheets of paper P stacked in stacker 128 are overlay-copied and discharged.

Figure 17:
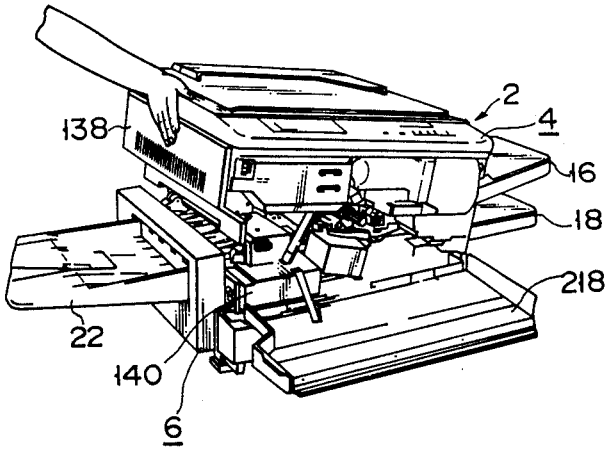
FIGS. 17 to 19 are views for explaining a process for removing jammed paper.

In the above-described copying operations, if paper P is jammed in copying apparatus 4, front cover 218 constituting part of housing 8 of copying apparatus 4 is opened and upper unit 138 is pulled upward, as shown in FIG. 17. Upon inspection of the convey path, jammed paper P is removed. Upper unit 138 is pushed down, and returned to the original position. Then, front cover 218 is closed.

Figure 18:
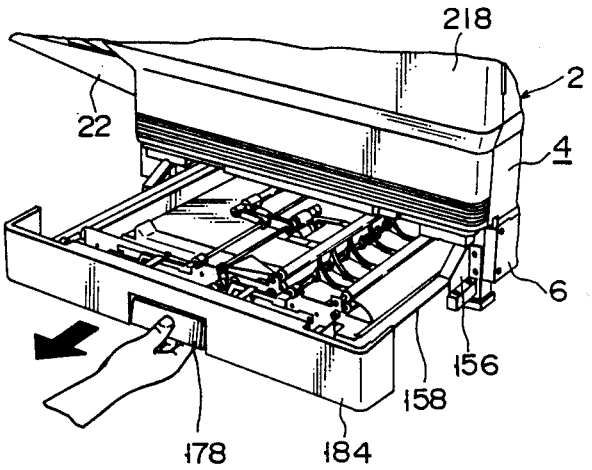
Figure 19:
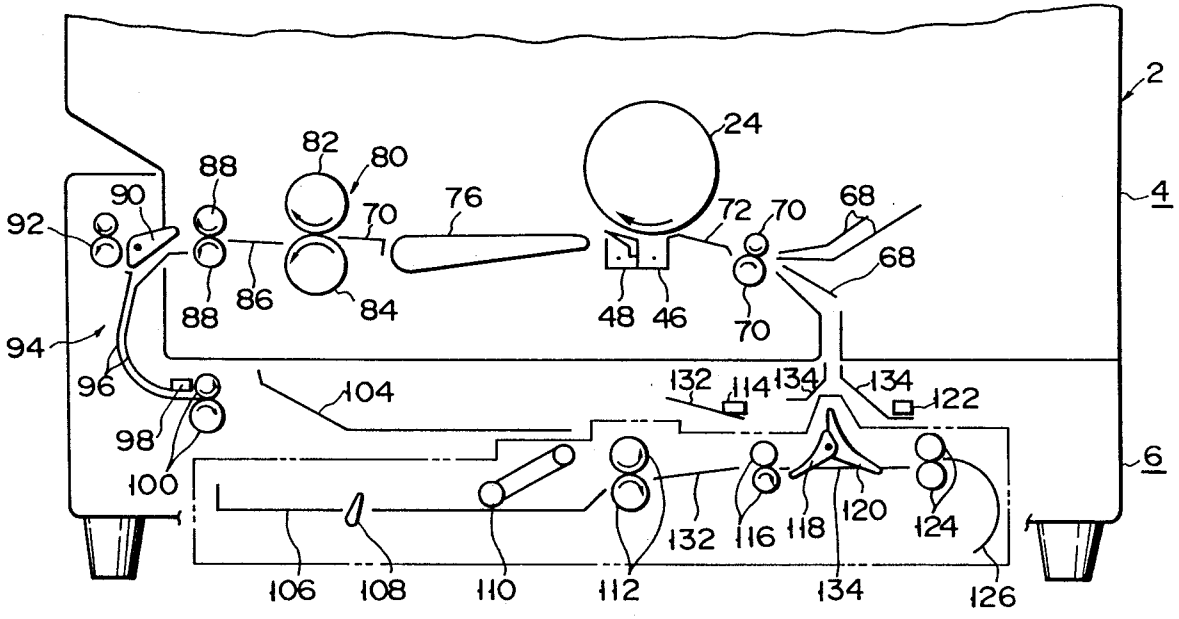

If paper P is jammed in paper re-feeding apparatus 6, subframe 158 is pulled toward a user by handle 178, as shown in FIG. 18. At this time, roller 200 is guided by curved portion 210 of guide groove 202, and at the same time roller 206 is guided by curved surface 214 of guide surface 208. Then, roller 200 is guided by flat portion 212 of guide groove 202, and roller 206 is simultaneously guided by flat surface 216 of guide surface 208. Flat portion 212 is formed at a position lower than guide surface 208, and curved surface 214 is formed at a position higher than flat surface 216. For this reason, as shown in FIG. 19, subframe 158 is lowered while it is kept horizontal. As a result, the convey path for paper P is widened. Since the convey path can be widely exposed without significantly increasing the height of the apparatus, jammed paper P can be easily removed. In addition, curved portion 210 of guide groove 202 is constituted by ascending portion 214 on the rear side and descending portion 216 on the front side. Therefore, when subframe 158 is pulled out, roller 200 must pass over curved portion 210 and subframe 158 is not accidentally pulled out.

Figure 20:
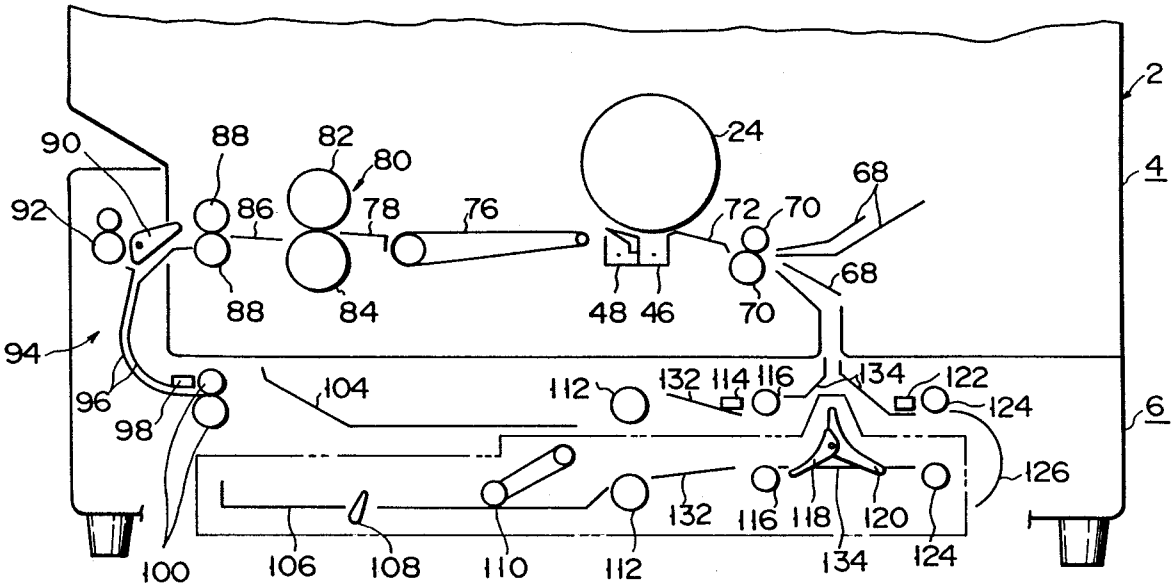
FIG. 20 is a schematic sectional view of a modification of the paper re-feeding apparatus according to the present invention.

The present invention is not limited to the above embodiment. For example, as shown in FIG. 20, upper separation roller 112, upper aligning roller 116, and upper switchback roller 124 may be arranged on main frame 156. With this arrangement, since separation rollers 112, aligning rollers 116, and switchback rollers 124 are separated upward and downward, respectively, when subframe 158 is pulled out, jammed paper can be further easily removed.

What is claimed is:

1. A paper re-feeding apparatus of an image forming apparatus, which feeds paper, on a surface of which an image has been formed by image forming means, to said image forming means again, comprising:

first convey means opposing one surface of the paper;

second convey means opposing the other surface of the paper; and support means for supporting said first and second convey means such that said second convey means is moved with respect to said first convey means in directions along and perpendicular to a surface of the paper.

2. The apparatus according to claim 1, wherein said support means comprises a support mechanism for supporting said first and second convey means such that said second convey means is movable in parallel to said first convey means.

3. The apparatus according to claim 2, wherein said support mechanism comprises a first frame for supporting said first convey means and a second frame, said second frame supporting said second convey means, guide means arranged in one of said first and second frames, and a portion formed on the other of said frames and to be guided by said guide means.

4. The apparatus according to claim 3, wherein said guide means comprises a guide groove formed in said first frame and a guide surface formed on said second frame, and said portion to be guided comprises a first projection formed on said second frame and guided by said guide groove, and a second projection formed on said first frame and guided by said guide surface.

5. The apparatus according to claim 4, wherein said first and second frames respectively support said first and second convey means such that the paper is conveyed in a substantially horizontal direction, said guide means and said portion to be guided guide said second frame with respect to said first frame such that said second frame is moved while being kept substantially horizontal from a first position where said first convey means opposes said second convey means to a second position where said first and second convey means do not oppose each other.

6. The apparatus according to claim 5, wherein said guide groove comprises a first curved groove portion for guiding said first projection at the first position and a second flat groove portion for guiding said first projection at the second position, and said guide surface comprises a first curved guide surface portion for guiding said second projection at the first position and a second flat guide surface portion for guiding said second projection at the second position.

7. The apparatus according to claim 6, wherein said first curved groove portion comprises a first ascending portion ascending from the first position toward the second position, and a second descending portion descending from the first position toward the second position.

8. The apparatus according to claim 1, wherein said first convey means comprises a first guide means opposing one surface of the paper, and said second convey means comprises a second guide means opposing the other surface of the paper.

9. The apparatus according to claim 8, wherein said first guide means has a first guide plate for guiding one surface of the paper, and a first stack guide, said second guide means has a second guide plate for guiding the other surface of the paper, and a second stack guide, and said apparatus further comprises a stacker for stacking paper formed between said first and second stack guides.

10. The apparatus according to claim 1, wherein said first convey means comprises a first guide means and a first convey member opposing one surface of the paper, said second convey means comprises a second guide member and a second convey member opposing the other surface of the paper, and said first and second convey members convey the paper by clamping the paper therebetween.

11. The apparatus according to claim 10, wherein said first guide means has a first guide plate for guiding one surface of the paper, and a first stack guide, said second guide means has a second guide plate for guiding the other surface of the paper, and a second stack guide, and said apparatus further comprises a stacker for stacking paper formed between said first and second stack guides.

12. A paper re-feeding apparatus of an image forming apparatus, which feeds paper, on a surface of which an image has been formed by image forming means, to said image forming means again, comprising:

paper feed means, in which sheets of paper are stored, for feeding paper sheets one by one to said image forming means;

paper discharge means for discharging paper sheets to the outside of said image forming apparatus;

convey means for conveying a paper sheet, fed by said paper feed means, to said paper discharge means through said image forming means;

reconvey means including first means opposing one surface of the paper sheet, and second means opposing the other surface of the paper sheet, said reconvey means conveying the paper sheet from a position between said image forming means and paper discharge means to a position between said paper feed means and image forming means; and support means for supporting said reconvey means in such a manner that at least part of said first means can be moved away from said second means and pulled to the outside of said paper re-feeding apparatus.

* * * * *